US011663983B2

(12) United States Patent
Williams et al.

(10) Patent No.: US 11,663,983 B2
(45) Date of Patent: May 30, 2023

(54) LIGHTING TECHNIQUES FOR DISPLAY DEVICES

(71) Applicant: Nook Digital, LLC, New York, NY (US)

(72) Inventors: David J. Williams, San Francisco, CA (US); Chen-Je Huang, Menlo Park, CA (US)

(73) Assignee: Nook Digital, LLC, New York, NY (US)

( * ) Notice: Subject to any disclaimer, the term of this patent is extended or adjusted under 35 U.S.C. 154(b) by 0 days.

(21) Appl. No.: 17/157,382

(22) Filed: Jan. 25, 2021

(65) Prior Publication Data

US 2021/0142741 A1 May 13, 2021

Related U.S. Application Data

(63) Continuation of application No. 16/390,616, filed on Apr. 22, 2019, now Pat. No. 10,923,043, which is a continuation of application No. 15/955,176, filed on Apr. 17, 2018, now Pat. No. 10,269,303, which is a continuation of application No. 13/946,481, filed on Jul. 19, 2013, now Pat. No. 9,953,584.

(60) Provisional application No. 61/675,159, filed on Jul. 24, 2012.

(51) Int. Cl.
*G09G 3/34* (2006.01)

(52) U.S. Cl.
CPC ..... *G09G 3/3406* (2013.01); *G09G 3/344* (2013.01)

(58) Field of Classification Search
CPC ..... G09G 3/3406; G06F 3/044; G06F 3/0416; G06F 3/04142; G06F 3/048
See application file for complete search history.

(56) References Cited

U.S. PATENT DOCUMENTS

| | | | |
|---|---|---|---|
| 5,845,136 | A | 12/1998 | Babcock |
| 7,268,775 | B1 | 9/2007 | Gettemy |
| 8,698,727 | B2 | 4/2014 | Herz et al. |
| 8,933,916 | B1 | 1/2015 | Doar |
| 8,963,816 | B2 | 2/2015 | Baik et al. |

(Continued)

OTHER PUBLICATIONS

"Reader Digital Book", http://store.sony.com/webapp/wcs/stores/servlet/ProductDisplay?catalogId=10551&storeId, 2 pages, printed from the Internet on Jul. 10, 2012.

(Continued)

*Primary Examiner* — Dennis P Joseph
(74) *Attorney, Agent, or Firm* — Finch & Maloney PLLC

(57) ABSTRACT

Techniques are disclosed for lighting displays such as those associated with electrophoretic display (EPD) devices such as e-readers or any other display technologies or applications. In an embodiment, an EPD device is provided with a number of internal LEDs or other suitable light source generally disposed along at least a portion of the display perimeter. The light can be activated in situations where the available ambient light is inadequate for viewing the display. Light from the light source is distributed across the display, and in some embodiments, can be adjusted to provide a desired degree of brightness. The light can be turned on or (Continued)

off via an existing single press-button or otherwise tactile, physical user interface that serves multiple functions. This user interface can be readily found and engaged by the user without the benefit of sight.

18 Claims, 5 Drawing Sheets

(56) References Cited

U.S. PATENT DOCUMENTS

| | | | | |
|---|---|---|---|---|
| 9,953,584 | B2 | 4/2018 | Williams et al. | |
| 10,269,303 | B2 | 4/2019 | Williams et al. | |
| 2003/0048599 | A1 | 3/2003 | Martin | |
| 2006/0099938 | A1 | 5/2006 | Lee | |
| 2008/0188267 | A1 | 8/2008 | Sagong | |
| 2010/0309096 | A1 | 12/2010 | Inoh | |
| 2010/0315394 | A1* | 12/2010 | Katoh | H04N 1/0461 345/207 |
| 2012/0218242 | A1* | 8/2012 | Ho | H01L 27/3232 345/211 |
| 2013/0076591 | A1* | 3/2013 | Sirpal | G06F 1/1649 345/1.3 |
| 2013/0139078 | A1 | 5/2013 | Chuang et al. | |
| 2013/0328842 | A1* | 12/2013 | Barnhoefer | G06F 3/0443 345/207 |
| 2014/0028735 | A1 | 1/2014 | Williams et al. | |
| 2018/0308435 | A1 | 10/2018 | Williams et al. | |
| 2019/0251913 | A1 | 8/2019 | Williams et al. | |

OTHER PUBLICATIONS

B. Heater, "Nook Simple Touch with GlowLight hands-on", downloaded from Internet from URL: http://www.engadget.com/2012/04/12/nook-simple-touch-with-glowlight-hands-on/, 8 pages, Apr. 12, 2012.

Barnes & Noble NOOK Simple Touch with GlowLight announced, Budget News 2010, downloaded from Internet from URL: http://budget-news-2010.blogspot.com/2012/04/barnes-noble-nook-simple-touch-with.html, 8 pages, Apr. 15, 2012.

J. Rettinger, "NOOK Simple Touch with GlowLight Unboxing (video)", downloaded from Internet from URL: http://www.technobuffalo.com/videos/nook-simple-touch-gallery/, 5 pages, Apr. 26, 2012.

M. Perenson "Barnes & Noble Nook Simple Touch With GlowLight Review: An E-Reader That Truly Lets You Read Anywhere", downloaded from Internet from URL: http://www.pcworld.com/article/254356/barnes_and_noble_nook_simple_touch_with_glowlight_review_an_e_reader_that_truly_lets_you_read_anywh.html, 5 pages, Apr. 24, 2012.

U.S. Appl. No. 16/390,616, filed Apr. 22, 2019, Pending.

U.S. Appl. No. 15/955,176, filed Apr. 17, 2018, Patented.

U.S. Appl. No. 13/946,481, filed Jul. 19, 2013, Patented.

* cited by examiner

LIGHTING TECHNIQUES FOR DISPLAY DEVICES

RELATED APPLICATION

This application is a continuation of U.S. patent application Ser. No. 16/390,616 filed on Apr. 22, 2019, which is a continuation of U.S. patent application Ser. No. 15/955,176 filed on Apr. 17, 2018 (now U.S. Pat. No. 10,269,303), which is a continuation of U.S. patent application Ser. No. 13/946,481 filed on Jul. 19, 2013 (now U.S. Pat. No. 9,953,584), which claims the benefit of U.S. Provisional Application No. 61/675,159 filed on Jul. 24, 2012. Each of these applications is herein incorporated by reference in its entirety.

FIELD OF THE DISCLOSURE

The invention relates to electronic display devices, and more particularly, to lighting techniques to assist display readability in low or no light situations.

BACKGROUND

Electrophoretic or so-called electronic paper display (EPD) devices are sometimes used in place of more traditional display technology such as LED displays, because once an image is fixed on the electronic paper, it can be maintained with little or no power. Thus, the readout can be seen even when the device is not plugged in or otherwise in an off-state. In addition, EPD devices are more amenable to direct sunlight viewing, unlike LED based devices. Example applications for EPD devices include e-readers, mobile phones, digital frames, information boards, and functional touch screens such as keyboards, as well as relatively small display applications such as status displays, electronic labels, smart card displays, and wristwatches. EPD devices generally require ambient light to be readable.

DETAILED DESCRIPTION

Figure 1A:
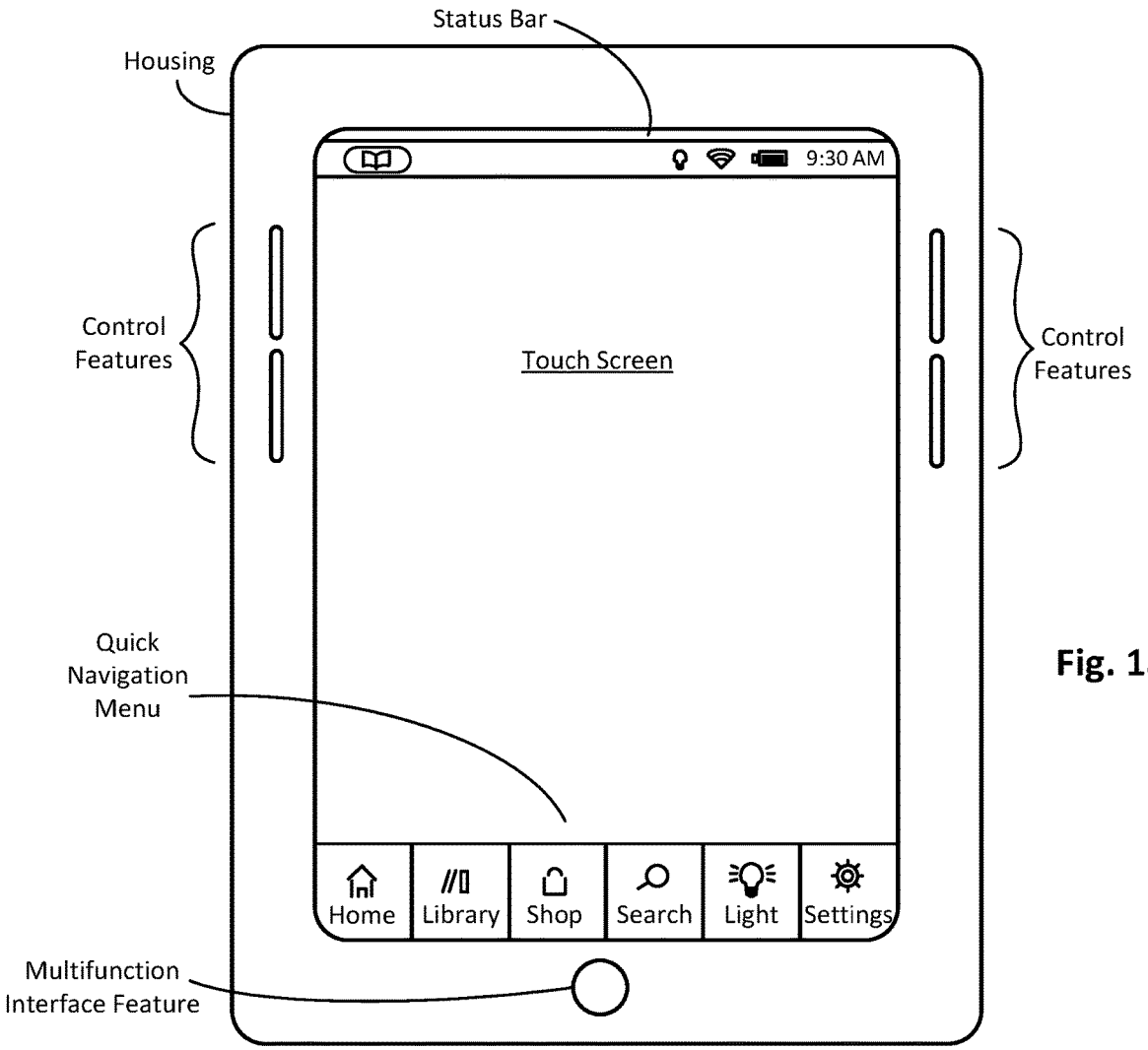
FIGS. 1*a-b* illustrate an electrophoretic display (EPD) device having a reading light feature configured in accordance with an embodiment of the present invention.

Techniques are disclosed for lighting displays such as those associated with electrophoretic display (EPD) devices such as e-readers or any other display technologies or applications. In an embodiment, an EPD device is provided with a number of internal LEDs or other suitable light source generally disposed along at least a portion of the display perimeter. The light can be activated in situations where the available ambient light is inadequate for viewing the display. Light from the light source is distributed across the display, and in some embodiments, can be adjusted to provide a desired degree of brightness. The light can be turned on or off via an existing single press-button or otherwise tactile, physical user interface that serves multiple functions. This user interface can be readily found and engaged by the user without the benefit of sight.

General Overview

As previously explained, EPD devices generally require ambient light to be readable. While some such devices have provided a reading light feature, the manner in which that light is activated is associated with a number of non-trivial issues. For instance, a new physical toggle switch or other dedicated switching mechanism allocated to turn the reading light on/off would be sufficient, but would generally add additional hardware cost to the device and would require the existing housing to be re-configured. In addition, a user interface that cannot be easily seen or otherwise located in low light or complete darkness may not be workable for all users. For instance, a touch screen control feature would not be particularly helpful if its location was unknown and it could not be seen by the user. In such cases, the mere task of turning the reading light on could be difficult in certain situations.

Thus, in accordance with an embodiment of the present invention, the reading light on/off functionality is integrated into an existing press-button switch or other hardware feature that allows for a tactile and physical interface that can be easily found without the aid of sight. For instance, in one specific example case, a press-button that has a primary function of providing the user access to a so-called home menu or quick navigation menu of a touch display user interface can be further configured to provide an on/off function for the reading light. As will be appreciated in light of this disclosure, the techniques provided herein are particularly well-suited for EPD applications, but can be used in conjunction with any display technology including LED displays, backlit displays, and CRT displays.

In some embodiments, the additional functionality can be provisioned, for example, via software configured to determine the duration that the press-button or other hardware feature is pressed or otherwise engaged by the user. In one example case, for instance, if the hardware feature is engaged only momentarily (e.g., 2 seconds or less), then the primary function is called and a home menu (or quick navigation menu) is provided to the user. However, if the hardware feature is engaged by the user for a longer period (e.g., greater than 2 seconds), then the reading light function is called and the light source is turned on. Once the light is on, the user can then see and interact with the display device as normally done.

The press-button or other hardware feature may support additional functionality as well if so desired, in accordance with some embodiments. For example, and continuing with the previous example, if the press-button or other hardware feature is pressed or otherwise engaged by the user for an even longer period (e.g., greater than 4 seconds), then a sleep function can be called and the device will go into sleep mode. Any number of multifunction schemes can be implemented with an existing hardware feature, so long as a tactile and physical experience for engaging a reading light is provided, and the claimed invention is not intended to be limited to any particular set of functionalities or user interface schemes.

As will be appreciated in light of this disclosure, leveraging an existing hardware feature can be carried out in a number of ways. In one example embodiment, timing and context can be used to give the user easy, tactile control of the reading light without any additional hardware. Rather, the user just interacts with an existing hardware feature in a different manner, but yet in a manner that is consistent with or otherwise compatible with existing behavior associated with that feature. Further note that, in some embodiments, the priority of the lighting function can be set to override other functions which would necessitate the ability to see the device interface. For example, in some example cases, assume that a device in sleep mode can only be awoken by a swiping gesture in a particular area on a touch screen display. In such cases, the light can be engaged and disengaged without waking the device if so desired. Thus, once the light is on, the user can then proceed to initiate the waking process via the visual interface.

User Interface and Architecture

Figure 1B:
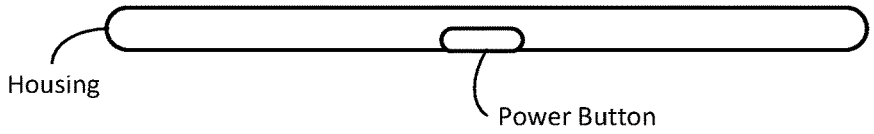

FIGS. 1*a-b* illustrate an electrophoretic display (EPD) device having a reading light feature configured in accordance with an embodiment of the present invention. The device could be, for example, an e-reader such as the NOOK® by Barnes & Noble. Other example applications for the EPD device may include mobile phones or computing devices, digital frames, information boards, and functional touch screens such as keyboards, status displays, electronic labels, smart card displays, and wristwatches, to name a few. In a more general sense, the techniques provided herein can be used in conjunction with any display technology including LED displays, plasma displays, OLED displays, backlit displays, and CRT displays, and may be used with any number of display devices (e.g., laptops, tablets, televisions, smart computer monitors, or any other device having a display). As such, the focus of this disclosure on EPD devices is not intended to limit the claimed invention.

Depending on the application, the device may have fewer or additional features, as will be appreciated, and the example embodiments provided herein are not intended to limit the claimed invention to a particular set of features or user controls or form factor, or to a particular application. Rather, the lighting techniques can be applied, for instance, to any EPD or other display device that may be used in an application where natural ambient light is unavailable or otherwise insufficient, wherein the EPD or other display device has an existing tactile/physical user interface that can be further purposed (by way of embedded software or logic) for turning on a display light.

As can be seen with this example configuration, the device comprises a housing that includes a number of hardware features such as a power button, control features, and a multifunction interface feature such as a press-button. A touch screen based user interface is also provided, which in this example embodiment includes a quick navigation menu having six main categories to choose from (Home, Library, Shop, Search, Light, and Settings) and a status bar that includes a number of icons (a light icon, a wireless network icon, and a book icon), a battery indicator, and a clock. Other embodiments may have fewer or additional such touch screen features, depending on the target application of the device. With the exception of the lighting function, each of these controls and features can generally be implemented using any suitable conventional or custom technology, as will be appreciated.

The control features in this example embodiment are configured as elongated press-bars and can be used, for example, to page forward (using the top press-bar) or to page backward (using the bottom press-bar), assuming an e-reader application. The power button can be used to turn the device on and off, and may be used in conjunction with a touch-based control feature that allows the user to confirm a given power transition action request (e.g., such as a slide bar or tap point graphic to turn power off). Numerous variations will be apparent.

In this example configuration, the multifunction interface feature is the one further purposed to include reading light control, in accordance with an embodiment of the present invention. For purposes of discussion, assume that this existing feature is a press-button normally used as follows: when the device is awake and in use, tapping the button will display the quick navigation menu, which is a toolbar that provides quick access to various features of the device. Now, in accordance with an embodiment of the present invention, when the device is awake and in use, tapping the button will still display the quick navigation menu, but if the user presses and holds (e.g., for 2 seconds) the multifunction button (instead of doing a quick tap), an embedded reading light will toggle from its current state (off to on, or on to off). Thus, a tactile and physical solution to the problem of establishing control of computing device in darkness or very low light situations is provided. The multifunction button may further control additional functionality if the user continues to press the button. For instance, an example third function could engage a power conservation routine where the device is put to sleep or an otherwise lower power consumption mode. So, a user could grab the device by the button, press and keep holding as the device was stowed into a bag or purse. One physical gesture that would safely put the device to sleep. Thus, in such an example embodiment, the multifunction interface feature is associated with and controls three different and unrelated functions: 1) show the quick navigation menu; 2) toggle the reading light; and 3) put the device to sleep.

In some embodiments, if the device is asleep and the reading light is off, pressing on the multifunction button will turn on the reading light. If the user continues to press the multifunction button (without releasing it), the reading light will go off. During this press-and-hold operation, the device will not come out of sleep mode (or other power conservation mode currently engaged) unless the user further activates the touchscreen wake control, for example. This behavior is still helpful in allowing a user to locate and press the multifunction button so that the user can see the device screen and proceed with an intended user action, but also guards against draining the batteries of the device when the multifunction button is accidentally pressed as the device is, for example, carried in a bag or stacked with books on a desk, etc (e.g., the reading light won't keep toggling on-and-off and the device will remain asleep when the multifunction button is inadvertently held down).

Figure 2:
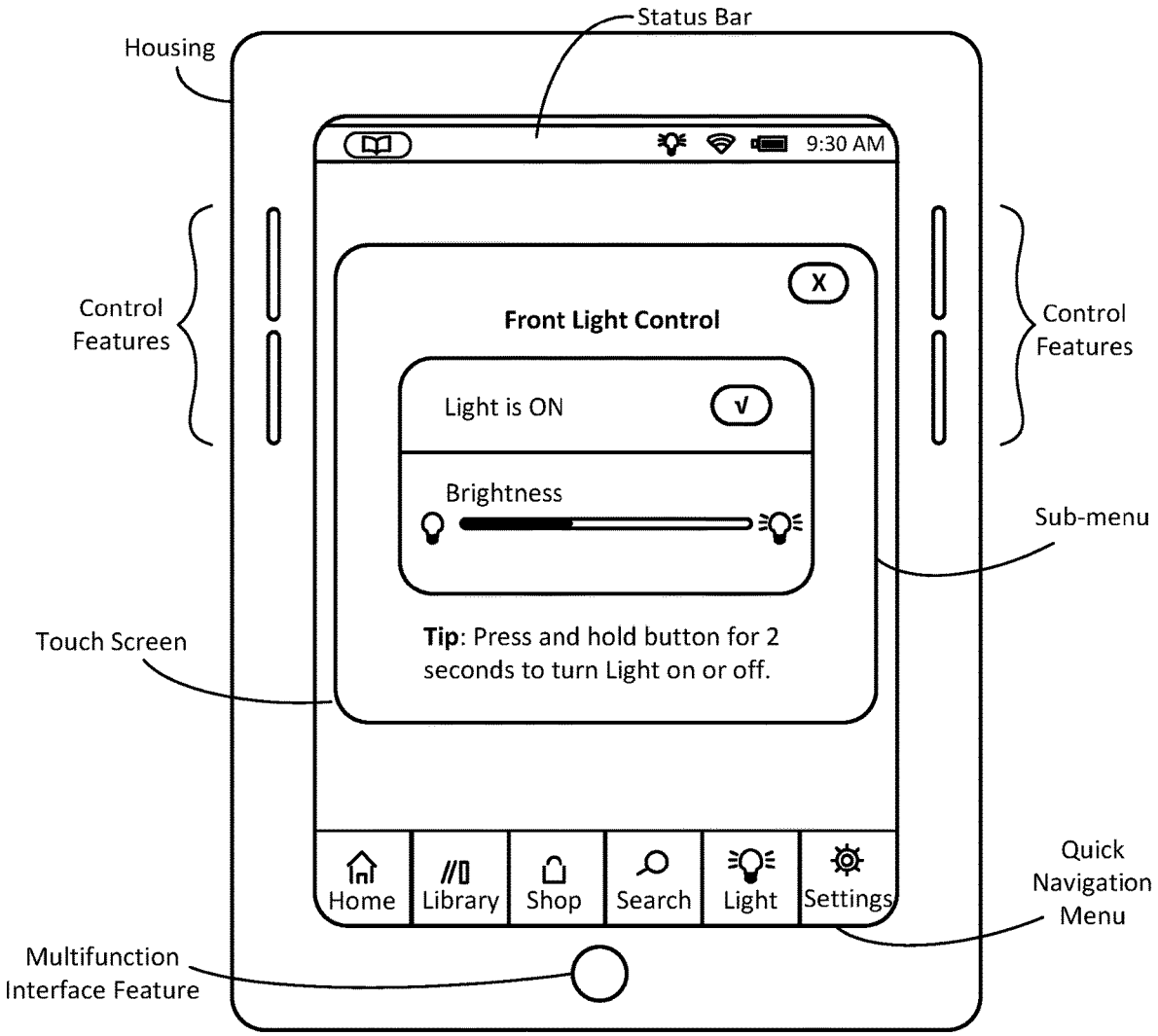
FIG. 2 illustrates a reading light control interface for the EPD device shown in FIGS. 1*a-b*, in accordance with an embodiment of the present invention.

In some embodiments, the reading light can also be engaged using the touch screen features of the device, assuming they can be seen or otherwise accessed. For instance, FIG. 2 illustrates a screen shot of a reading light control interface for the EPD device shown in FIGS. 1*a-b*, in accordance with an embodiment of the present invention. This is an example graphical user interface that can be provided to the user in response to the user tapping the Light option of the quick navigation menu. As can be seen, once the interface is displayed, the user can select the check box to turn the reading light on (e.g., the message "Light is ON" will appear along with the checked box). If the light is on, and the user wishes to turn it off, then the user can simply tap the check box to uncheck it and the reading light will turn off in response. In such a case, a message of "Light is OFF"

can be provided and/or the slide bar area can be greyed out so as to indicate that light is not on. Likewise, a Tip message can be presented to the user as shown to further assist the user with understanding device operation. In addition, a slide bar control may also be provisioned in the touch screen user interface to allow the user to adjust the brightness of the light. Once the user is satisfied with the reading light settings, the X in the upper right corner of the sub-menu can be tapped to close the configuration screen and return to the previous screen.

As can be further seen, the status bar may also include an indicator that the reading light is either on (lit bulb icon) or off (unlit bulb icon). In some such cases, the user can also access a sub-menu that provides access to the lighting function by tapping the icon of the status bar (or tapping the status bar itself). Such a sub-menu may further include other touch screen control features indicated in the status bar as well, such as a wireless network on/off check box (for connecting or disconnecting to a local wireless network).

Such user interface touch screen controls as shown in FIG. 2 (as well as FIGS. 1*a* and 3*a-b*) can be programmed or otherwise configured using any number of conventional or custom technologies as will be appreciated in light of this disclosure. In general, the touch screen translates the user touch in a given location into an electrical signal which is then received and processed by the underlying circuitry (processor, etc). Additional example details of the underlying circuitry will be discussed in turn with reference to FIG. 4.

Figure 3A:
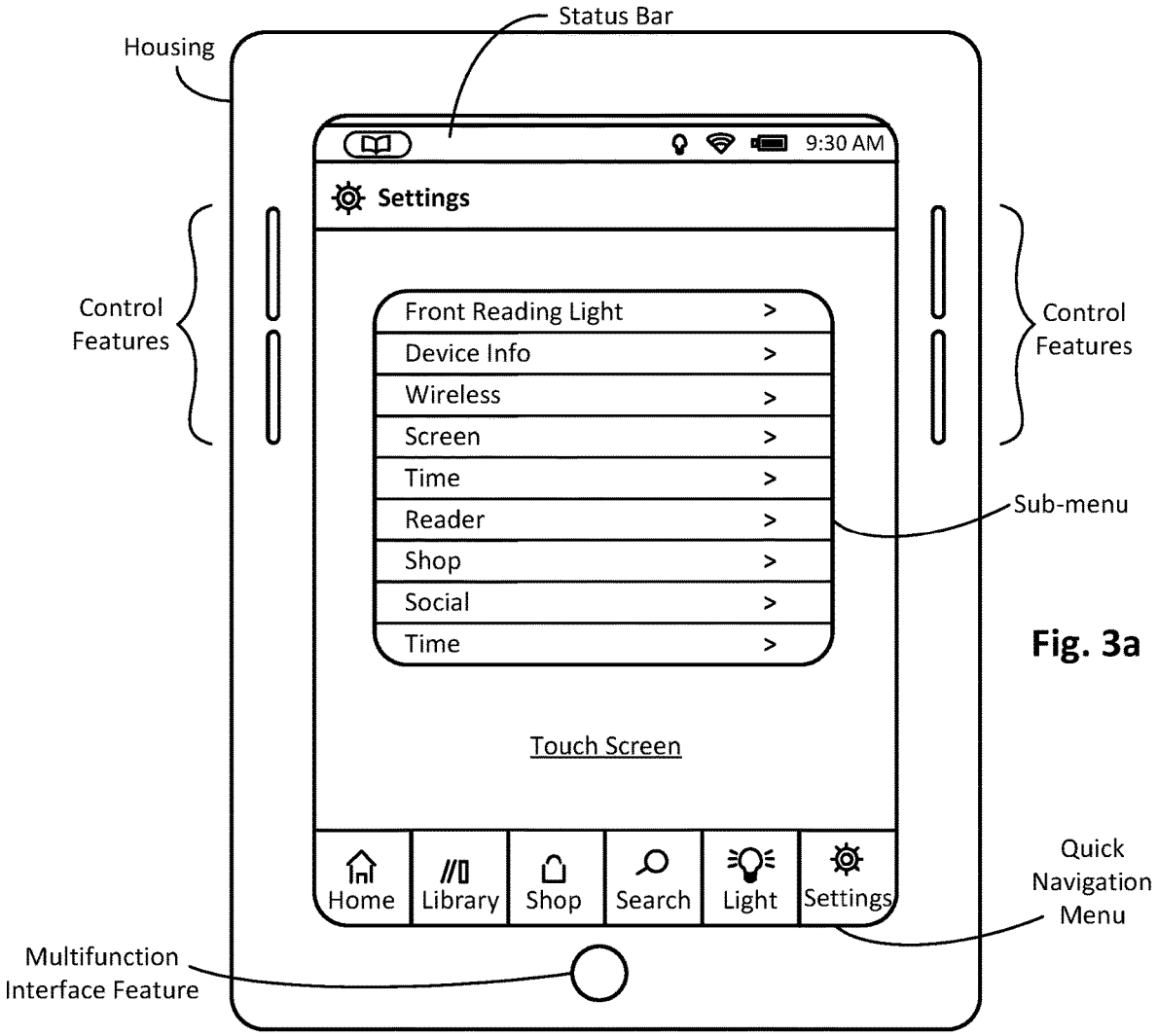
FIGS. 3*a-b* illustrate a reading light control interface for the EPD device shown in FIGS. 1*a-b*, in accordance with another embodiment of the present invention.
Figure 3B:
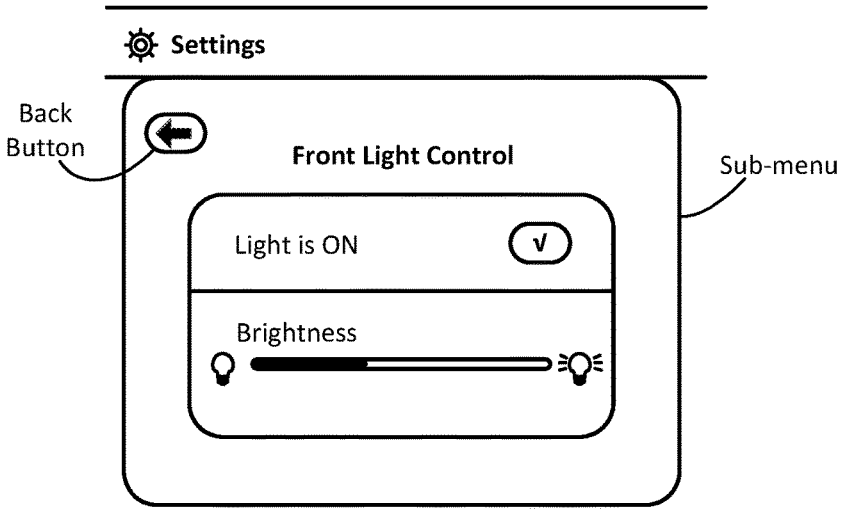
Figure 4:
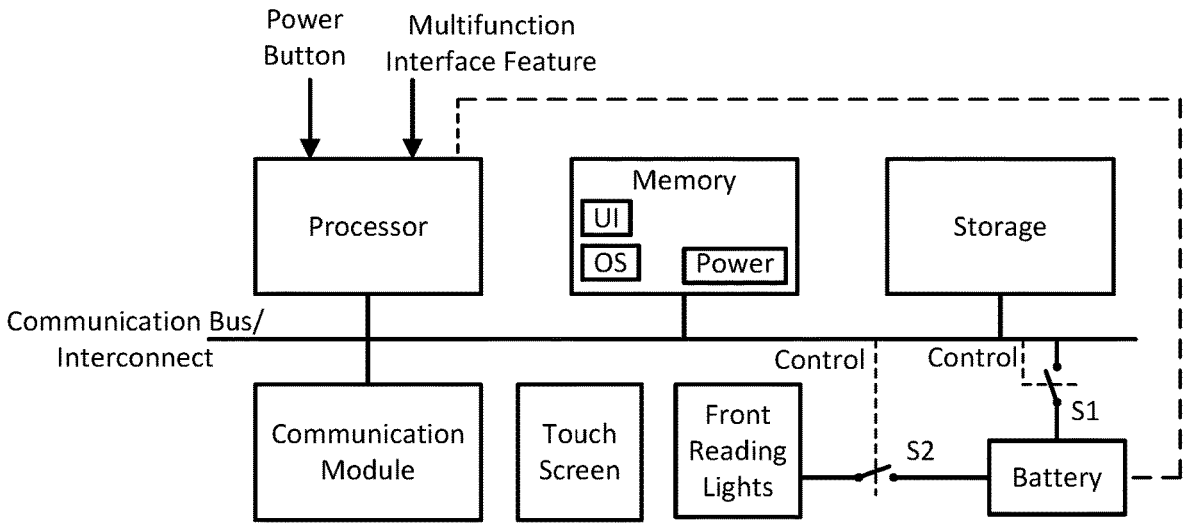
FIG. 4 illustrates a block diagram of an EPD or other display device configured in accordance with an embodiment of the present invention.

FIGS. 3*a-b* illustrate a reading light control menu for the EPD device shown in FIGS. 1*a-b*, in accordance with another embodiment of the present invention. This is another example sub-menu that can be provided to the user in response to the user tapping the Settings option of the quick navigation menu. As can be seen in FIG. 3*a*, once the Settings sub-menu is displayed, the user can then select the Front Reading Light option. In response to such a selection, the sub-menu shown in FIG. 3*b* can be provided to the user. The previous relevant discussion with respect to FIG. 2 relevant to the light control features is equally applicable here. In addition, a back button is provisioned in the touch screen user interface, so that the user can go back to the Settings menu after the light has been configured, if so desired FIG. 4 illustrates a block diagram of an EPD or other display device configured in accordance with an embodiment of the present invention. As can be seen, this example device includes a processor, memory (e.g., RAM and/or ROM for processor workspace and storage), additional storage/memory (e.g., for content), a battery, a communications module, a touch screen, and front reading lights. A communications bus and interconnect is also provided to allow inter-device communication. Other typical componentry and device functionality not reflected in the block diagram will be apparent in light of this disclosure.

In this example embodiment, the memory includes a number of modules stored therein that can be accessed and executed by the processor (and/or a co-processor). The modules include an operating system (OS), a user interface (UI), and a power conservation routine (Power). The modules can be implemented, for example, in any suitable programming language (e.g., C, C++, objective C, JavaScript, custom or proprietary instruction sets, etc), and encoded on a machine readable medium, that when executed by the processor, carries out the functionality of the device including lighting functionality as described herein. Other embodiments can be implemented, for instance, with gate-level logic or an application-specific integrated circuit (ASIC) or chip set or other such purpose built logic, or a microcontroller having input/output capability (e.g., inputs for receiving user inputs and outputs for directing other components) and a number of embedded routines for carrying out the device functionality. In short, the functional modules can be implemented in hardware, software, firmware, or a combination thereof.

The processor can be any suitable processor (e.g., 800 MHz Texas Instruments OMAP3621 applications processor), and may include one or more co-processors or controllers to assist in device control. In this example case, the processor receives input from the user, including input from or otherwise derived from the power button and the multi-function interface feature. The processor can also have a direct connection to the battery so that it can perform base level tasks even during sleep or low power modes. The memory can be any suitable type of memory and size (e.g., 256 or 512 Mbytes SDRAM), and in other embodiments may be implemented with non-volatile memory or a combination of non-volatile and volatile memory technologies. The storage can also be implemented with any suitable memory and size (e.g., 2 GBytes of flash memory). The display can be implemented, for example, with a 6-inch E-ink Pearl 800×600 pixel screen with Neonode® zForce® touchscreen, or any other suitable display and touchscreen interface technology. The communications module can be, for instance, any suitable 802.11 b/g/n WLAN chip or chip set, which allows for connection to a local network so that content can be downloaded to the device from a remote location (e.g., content provider, etc, depending on the application of the display device). The battery can be, for example, a lithium ion battery, although any suitable battery technology can be used. The front reading lights can be implemented with any suitable light source, but in one embodiment include eight LEDs mounted just above the e-ink display. In one such embodiment, the LEDs (or other suitable light source) are mounted into a display mounting plate. The mounting plate can be made, for example, of die cast aluminium or magnesium alloy (e.g., AZ91D) or other suitable material. In other embodiments, there may be more or fewer LEDs and they may be disposed on multiple sides of the display, if so desired. For instance, in one example embodiment, eight to sixteen LEDs can be spread around the perimeter of the display screen so as to provide a desired amount of light and distribution. In some specific example embodiments, the device housing that contains all the various componentry measures about 6.5" high by about 5" wide by about 0.5" thick, and weighs about 6.9 ounces. Any number of suitable computing device form factors can be used, depending on the target application. The device may be smaller, for example, for labeling and smartphone and smartcard applications and larger for information board applications.

The operating system (OS) module can be implemented with any suitable OS, but in some example embodiments is implemented with Google Android OS or Linux OS. The power management (Power) module can be configured as typically done, such as to automatically transition the device to a low power consumption mode after a period of non-use. A wake-up from that sleep mode can be achieved, for example, by a physical button press and/or a touch screen swipe or other action. The user interface (UI) module can be, for example, based on the various screen shots shown in FIGS. 1-3*b* and Neonode® zForce® touchscreen technology, in conjunction with the various functionalities described herein. If additional space is desired, for example, to store digital books or other content and media, storage can be expanded via a microSD card or other suitable memory expansion technology (e.g., up to 32 GBytes, or higher).

In the embodiment shown, the switches S1 and S2 can be controlled based on user input and/or as directed by the processor. For instance, switch S1 can be opened during sleep mode so that only certain devices have access to power during that mode. In one such case, the processor and the front reading lights circuit can still be powered during sleep mode. Switch S2 allows the front reading lights to be powered even when switch S1 is open. Control can be provided to the switches via the communication bus, or by a dedicated connection to the processor. Numerous power switching and power conservation schemes can be implemented in accordance with an embodiment of the present invention.

Timing and Context

Figure 5A:
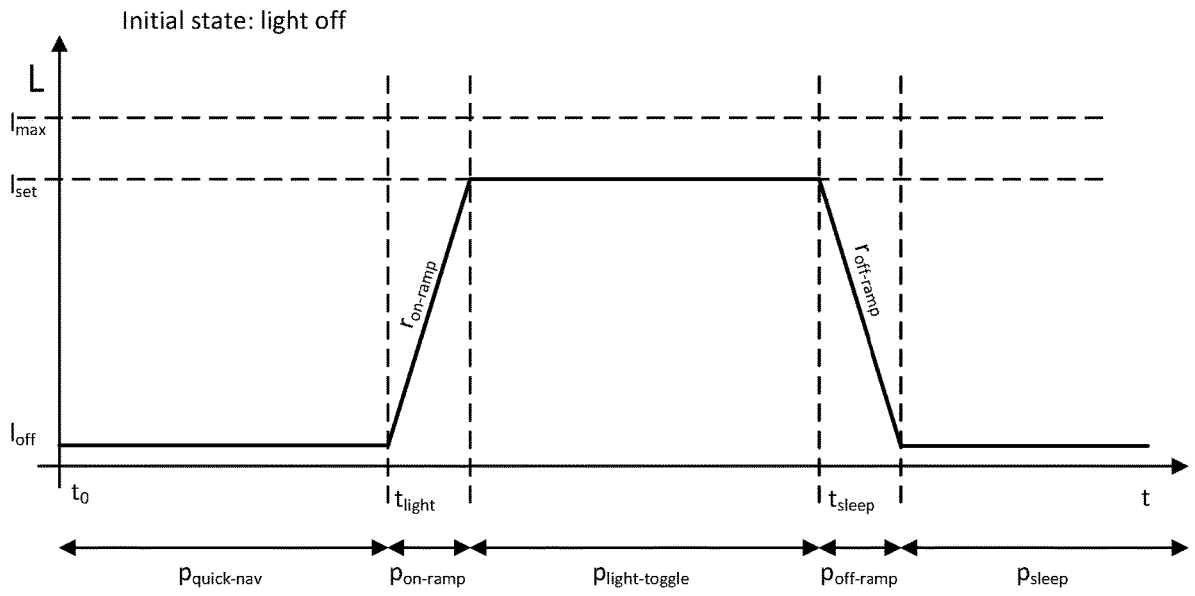
FIGS. 5*a-b* show timing diagrams that demonstrate a reading light function that leverages an existing hardware feature, in accordance with an embodiment of the present invention.
Figure 5B:
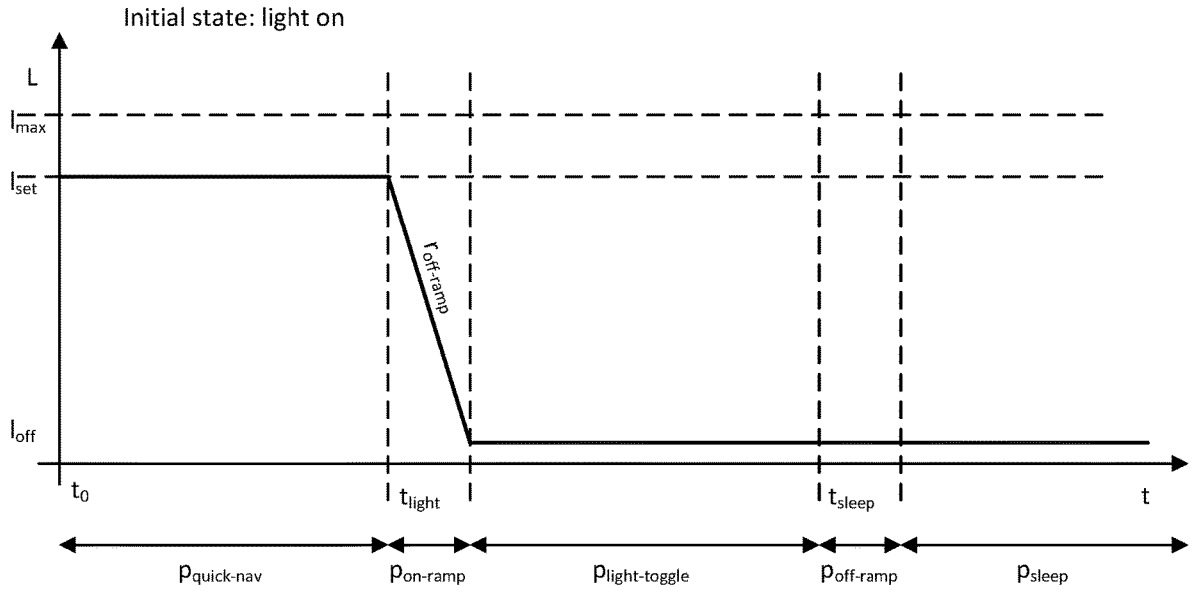

FIGS. 5*a-b* show timing diagrams that demonstrate a reading light function that leverages an existing hardware feature, in accordance with an embodiment of the present invention. As will be appreciated, the example timing sequences can be implemented, for instance, to increase the functionality of a so-called 'Home' or 'Main Menu' button on front light enabled EPD devices, in some embodiments. Other multipurpose hardware features can be implemented as well.

FIG. 5*a* shows the timing diagram when the initial state of the reading light is off, and FIG. 5*b* shows the timing diagram when the initial state of the reading light is on. As can be seen in this example case, there are three functions (post quick navigation menu, toggle reading light, engage sleep mode) associated with the button/hardware feature, and therefore three specific times ($t_0$, $t_{light}$, and $t_{sleep}$, respectively) that are relevant for a given button press and release scenario (or other hardware feature engagement). For purposes of this example embodiment, assume the hardware feature is a press-button.

In more detail, and with reference to FIGS. 5*a-b*, pressing the button at time $t_0$ and then releasing the button before time $t_{light}$ will engage the quick navigation menu feature (as shown in FIGS. 1*a*, 2, and 3*a-b*). This relatively quick button press-and-release action will manifest as an electrical signal that is received by the processor, which in turn executes a UI routine to cause the quick navigation menu feature to post. At this point, the front reading light will remain in its current state (prior to button press), which in FIG. 5*a* is off and in 5*b* is on. This functionality can be, for example, existing functionality of a given EPD e-reader or other computing device having a reading light feature that can only be engaged via a touchscreen user control, as will be appreciated in light of this disclosure.

With further reference to FIGS. 5*a-b*, pressing the button at time $t_0$ and then holding the button through to time $t_{light}$ but releasing it before time $t_{sleep}$ will turn the front reading light on so as to illuminate the touch screen (or turn the light off if it was already on). In one such example case, and with reference to the embodiment of FIG. 4, this particular button press and release action will manifest as an electrical signal that is received by the processor, which in turn sends a control signal to switch S2 so that power is provided to the front reading light circuit (or so that power is disconnected if the light is already on). Note that the quick navigation menu feature need not post in this scenario, but it may if so desired (and the device is not asleep or otherwise locked). In either case, the front reading light will toggle from its current state (prior to button press). Thus, with respect to FIG. 5*a* the light will toggle from off to on (e.g., at its current brightness setting or some default brightness setting), and with respect to FIG. 5*b* the light will toggle from on to off.

In addition, in some embodiments such as the ones represented in FIGS. 5*a-b*, once the press/release criteria for toggling the reading light have been met, power to the light may be ramped up to full power (or other desired intermediate power level) or ramped down to no power. With reference to the example embodiment of FIG. 4, the processor can control the level of power provided and cause the ramp up or ramp down condition as desired. For instance, if the front reading light was previously off at time $t_{light}$, the light will begin a timed ramp-up of period $p_{on\text{-}ramp}$ to increase brightness to the current (or default initial) setting. On the other hand, if the light was previously on at time $t_{light}$, the light will begin a timed ramp-down of period $p_{off\text{-}ramp}$ to decrease brightness until after period $p_{off\text{-}ramp}$ when the light will turn off. In general, the brightness is directly proportional to the amount of LED current provided by the battery (which in the example embodiment shown can be anywhere in the range from $I_{off}$ to $I_{max}$, and is actually set to a value of $I_{set}$). In some embodiments, the processor controls the amount of LED current using a control word provided to the battery/power module. Other embodiments may have, for instance, a dedicated power control circuit that carries out a similar function. The ramp-up or ramp-down times can vary from one embodiment to the next, and in some cases are user-configurable (e.g., users may wish to control the lighting experience). In addition, or alternatively, the ramp rate may be dynamically computed based on the brightness level. For instance, if the previous brightness is determined to be above a certain threshold, then the ramp rate can be made slower so as to avoid providing that high intensity too quickly. Likewise, if the previous brightness is determined to be below a certain threshold, then the ramp rate can be made faster or eliminated so as to provide that lower intensity more quickly. Further note that the ramp-up rate need not be the same as the ramp-down rate. For instance, in some embodiments, a ramp-up rate may be provided when turning the light on, and a faster ramp-down rate (or no ramp-down rate) can be used when turning the light off. Still other embodiments may turn the reading light on or off with no corresponding ramp-up or ramp-down.

With further reference to FIGS. 5*a-b*, pressing the button at time $t_0$ and then holding the button through to time $t_{sleep}$ and then releasing the button sometime after will sleep engage the sleep feature to commence the period $p_{sleep}$. In such cases, if the light is on at time $t_0$, the light will turn off and the device will go to sleep. On the other hand, and in accordance with some embodiments, if the light is off at time $t_0$, the light will turn on and then turn off and the device will go to sleep. If a ramp-up and ramp-down of the light is configured, that can occur as well. Further note that the quick navigation menu feature need not post in this scenario. The period $p_{quick\text{-}nav}$ includes the period from time $t_0$ to just prior to the light beginning to toggle, and the period $p_{light\text{-}toggle}$ generally includes the time from the light indicating the toggled state to just prior to the device beginning to go to sleep, and the period $p_{sleep}$ generally includes the time from when the device goes to sleep. Other embodiments may vary, for instance, with respect to what time is included within what time period, but the general concepts provided herein can equally apply.

As will be appreciated, the various times depicted can vary from one embodiment of the next. In one example case, period $p_{quick\text{-}nav}$ is about 1000 milliseconds (ms) or less, and the period $p_{light\text{-}toggle}$ is about 1000 to 3000 ms, and the on/off ramps are a constant rate with period from minimum to maximum brightness of about 50 ms to 500 ms. Table 1 illustrates one specific example timing configuration, which may or may not include ramp-up and/or ramp-down times.

TABLE 1

| Multipurpose Hardware Feature Timing | |
|---|---|
| Press-switch Hold time | Response |
| 0-2 seconds | Toggle Quick Nav Menu on release |
| At 2 seconds | Toggle reading light |
| 2-5 seconds | Save new light state variable on release |
| At >5 seconds | Light off, go to sleep (no saving light state variable) |

Numerous variations and configurations will be apparent in light of this disclosure. For example, one embodiment of the present invention provides a device that includes a display, an internal light source adjacent the display, and a hardware user interface control feature having first and second functions associated therewith. One of the first and second functions is with respect to switching the internal light source on and off, and the other function is unrelated to switching the internal light source on and off. In some cases, the device is an e-reader or tablet. In some cases, the display is an electrophoretic display (EPD). In some cases, the device further includes a user interface that allows brightness of the internal light source to be adjusted. In some cases, the first function is selected when the hardware user interface control feature is engaged for a first time duration commencing from time $t_0$, and the second function is selected when the hardware user interface control feature is engaged for a second time duration commencing from time $t_0$, wherein the second time duration is longer than the first time duration. In one such case, the second function is with respect to switching the internal light source on and off, and the first function is not selected when the hardware user interface control feature is engaged for the second time duration. In another such case, the hardware user interface control feature has a third function associated therewith that is unrelated to the first and second functions, and wherein the third function is selected when the hardware user interface control feature is engaged for a third time duration commencing from time $t_0$, wherein the third time duration is longer than the second time duration. In one such case, if the light source is off at time $t_0$, the light source will turn on and then turn off when the hardware user interface control feature is engaged for the third time duration. In one such case, the hardware user interface control feature is a press button. In some cases, when the light source is off at time $t_0$ and the hardware user interface control feature is engaged for an appropriate duration commencing from time $t_0$, the light source will begin a timed ramp-up period to increase brightness to a current brightness setting. In addition, when the light source is on at time $t_0$ and the hardware user interface control feature is engaged for an appropriate duration commencing from time $t_0$, the light source will begin a timed ramp-down period to decrease brightness until the light source is off. In one such case, the ramp-up and ramp-down periods are user-configurable. In another such case, at least one of the ramp-up and ramp-down periods is associated with a ramp rate that is dynamically computed based on brightness level of the light source. In some cases, the device includes a power source, a first switch operatively coupled between the power source and the light source, a second switch operatively coupled between the power source and other components of the device, and a processor configured to control the first and second switches. The first switch allows the light source to be powered even when the second switch is open. In some such cases, the processor controls the amount of current provided to the light source based on a user-configurable brightness setting.

Another example embodiment of the present invention provides a device that includes a power source, a display, an internal light source adjacent the display, and a hardware user interface control feature having first and second functions associated therewith. One of the first and second functions is with respect to switching the internal light source on and off, and the other function is unrelated to switching the internal light source on and off. The first function is selected when the hardware user interface control feature is engaged for a first time duration commencing from time $t_0$ and the second function is selected when the hardware user interface control feature is engaged for a second time duration commencing from time $t_0$, wherein the second time duration is longer than the first time duration. The device further includes a first switch operatively coupled between the power source and the light source, a second switch operatively coupled between the power source and other components of the device, and a processor configured to control the first and second switches, wherein the first switch allows the light source to be powered even when the second switch is open. The device further includes a user interface that allows brightness of the light source to be adjusted. In some cases, the second function is with respect to switching the internal light source on and off, and the first function is with respect to posting a quick navigation menu, and wherein the quick navigation menu is not posted when the hardware user interface control feature is engaged for the second time duration. In some cases, the hardware user interface control feature has a third function associated therewith that is unrelated to the first and second functions, and wherein the third function is with respect to a power conservation mode that is engaged when the hardware user interface control feature is engaged for a third time duration commencing from time $t_0$, wherein the third time duration is longer than the second time duration. In one such example case, if the light source is off at time $t_0$, the light source will turn on and then turn off when the hardware user interface control feature is engaged for the third time duration.

Another example embodiment of the present invention provides a non-transitory computer program product comprising a plurality of instructions encoded thereon to facilitate operation of an electronic device according to the following process: in response to a hardware user interface control feature being engaged for a first time duration commencing from time $t_0$, execute a first function; and in response to the hardware user interface control feature being engaged for a second time duration commencing from time to, execute a second function. The second time duration is longer than the first time duration. In addition, one of the first and second functions is with respect to switching an internal light source of the device on and off, and the other function is unrelated to switching the internal light source on and off. In some cases, the process further includes: in response to input via a brightness control interface, adjust brightness of the internal light source. In some cases, the second function is with respect to switching the internal light source on and off, and the first function is not executed when the hardware user interface control feature is engaged for the second time duration. In some cases, the process further comprises: in response to the hardware user interface control feature being engaged for a third time duration commencing from time $t_0$, execute a third function that is unrelated to the first and second functions, wherein the third time duration is longer than the second time duration. In one such case, the process further comprises: in response to the light source being off at time $t_0$ and the hardware user interface control feature being engaged for the third time duration, turn on the light source and then turn off the light source. In some cases, the process further comprises: in response to the light source being off at time to and the hardware user interface control feature being engaged for an appropriate duration commencing from time $t_0$, commence a timed ramp-up period to increase brightness to a current brightness setting; and in response to the light source being on at time $t_0$ and the hardware user interface control feature being engaged for an appropriate duration commencing from time $t_0$, commence a timed ramp-down period to decrease brightness until the light source is off. In some cases, the device includes a power source, a first switch operatively coupled between the power source and the light source, a second switch operatively coupled between the power source and other components of the device, and a processor, and the process further comprises: control, by the processor, the first and second switches, wherein the first switch allows the light source to be powered even when the second switch is open. The computer program product may include, for example, one or more computer readable mediums such as, for instance, a hard drive, compact disk, memory stick, server, cache memory, register memory, random access memory, read only memory, flash memory, or any suitable non-transitory memory that is encoded with instructions that can be executed by one or more processors, or a plurality or combination of such memories.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

The invention claimed is:

1. A computer program product comprising one or more non-transitory machine readable mediums having instructions encoded thereon that when executed by one or more processors cause a process to be carried out in an electronic device having an electrophoretic display that can be illuminated using one or more light sources mounted around one or more sides of the electrophoretic display, the process comprising:

in response to a first user input received via a tactile user interface feature for a first time duration, causing a first function to be carried out;

in response to a second user input received via the tactile user interface feature for a second time duration longer than the first time duration, causing a second function to be carried out; and in response to a third user input received via the tactile user interface feature for a third time duration longer than the second time duration, causing the electronic device to enter a sleep mode, causing a first switch coupled between a power source and a communication bus to open, and causing a second switch coupled between the power source and the one or more light sources to close if it is not closed already;

wherein one of the first or second functions does not include changing an illumination state of the one or more light sources, and wherein the other of the first or second functions includes changing an illumination state of the one or more light sources without transitioning the electronic device into a sleep mode or out of the sleep mode.

2. The computer program product of claim 1, wherein:

causing the first function to be carried out includes causing a menu to be presented for display via the display; and causing the second function to be carried out includes causing the one or more light sources of the device to change from on to off, or from off to on.

3. The computer program product of claim 2, wherein the second time duration is longer than the first time duration.

4. The computer program product of claim 1, wherein the third function includes engaging a power conservation mode.

5. The computer program product of claim 1, wherein causing the first or second function to be carried out includes one or both of (1) causing the one or more light sources of the device to be connected to a power source; and (2) causing the one or more light sources of the device to change in brightness level.

6. The computer program product of claim 1, wherein causing the first or second function to be carried out includes causing the second switch to toggle from a first position to a second position thereby causing the one or more light sources of the device to change from on to off, or from off to on.

7. An electronic device comprising the electrophoretic display, the one or more light sources that can be switched on to illuminate the electrophoretic display, and the computer program product of claim 1.

8. The computer program product of claim 1, wherein changing the illumination state of the one or more light sources comprises ramping up a brightness of the one or more light sources at a first ramp rate or ramping down the brightness of the one or more light sources at a second ramp rate.

9. The computer program product of claim 8, wherein the first ramp rate is slower than the second ramp rate.

10. The computer program product of claim 8, wherein one or both of the first ramp rate and the second ramp rate depend on a current brightness level of the one or more light sources.

11. The computer program product of claim 10, the process comprising:

in response to the current brightness level being below a first threshold, ramping down the brightness includes increasing the ramp rate to the second ramp rate; and in response to the current brightness level being above a second threshold, ramping up the brightness includes decreasing the ramp rate to the first ramp rate.

12. The computer program product of claim 10, the process comprising:

in response to the current brightness level being below a threshold, ramping down the brightness includes transitioning the one or more light sources from an on-state directly to an off-state.

13. An electronic device, comprising:

a housing;

an electrophoretic display within the housing;

a light source within the housing and configured to illuminate the electrophoretic display, the light source including a plurality of light emitting diodes disposed along at least a portion of the electrophoretic display perimeter;

a communication bus;

a tactile user interface feature mounted within the housing;

a power source;

a first switch between the power source and the communication bus;

a second switch between the power source and the light source; and one or more processors within the housing;

wherein, in response to a first user input received via the tactile user interface feature for a first time duration, the one or more processors execute first instructions to cause a menu to be posted to the electrophoretic display, wherein, in response to a second user input received via the tactile user interface feature for a second time duration longer than the first duration, the one or more processors execute second instructions to cause changing illumination of the electrophoretic display by affecting a state of the light source, and to toggle a state of the second switch, wherein, in response to a third user input received via the tactile user interface feature for a third time duration longer than the second time duration, the one or more processors execute third instructions to cause the electronic device to enter a sleep mode, to cause the first switch to open, and to cause the second switch to close if it is not closed already.

14. The electronic device of claim 13, wherein the second instructions include one or both of (1) causing the light source of the device to be connected to a power source; and (2) causing the light source of the device to change in brightness level.

15. The electronic device of claim 13, wherein the second instructions include causing the second switch to toggle from a first position to a second position thereby causing the lighting source of the device to change from on to off, or from off to on.

16. The electronic device of claim 13, wherein the second instructions include changing the illumination of the electrophoretic display by ramping up a brightness of the light source or ramping down a brightness of the light source.

17. The electronic device of claim 16, wherein the second instructions include ramping up the brightness of the light source at a first ramp rate or ramping down the brightness of the light source at a second ramp rate, wherein one or both of the first ramp rate and the second ramp rate depend on a current brightness level of the light source.

18. A method of affecting the illumination of an electrophoretic display on an electronic device having a tactile user interface feature, the method comprising:

in response to a first user input received via the tactile user interface feature for a first time duration, causing a first function to be carried out;

in response to a second user input received via the tactile user interface feature for a second time duration longer than the first time duration, causing a second function to be carried out but not the first function; and in response to a third user input received via the tactile user interface feature for a third time duration longer than the second time duration, causing the electronic device to enter a sleep mode, causing a first switch coupled between a power source and a communication bus to open, and causing a second switch coupled between the power source and a light source of the electronic device to close if it is not closed already;

wherein the first function comprises causing a menu to be presented for display via the electrophoretic display, and wherein the second function comprises causing the light source of the electronic device to change from on to off, or from off to on.

* * * * *